US005141342A

United States Patent [19]

Kawahara

[11] Patent Number: 5,141,342

[45] Date of Patent: * Aug. 25, 1992

[54] MOUNTING MECHANISM FOR RIBBON CASSETTE

[75] Inventor: Morihisa Kawahara, Kawasaki, Japan

[73] Assignee: Fujitsu Limited, Kawasaki, Japan

[ * ] Notice: The portion of the term of this patent subsequent to Aug. 18, 2009 has been disclaimed.

[21] Appl. No.: 612,861

[22] Filed: Nov. 14, 1990

[30] Foreign Application Priority Data

Nov. 20, 1989 [JP] Japan ..... 1-301013

[51] Int. Cl.[5] ..... B41J 32/00

[52] U.S. Cl. ..... 400/207; 400/194; 400/208

[58] Field of Search ..... 400/207, 208, 352, 207 E, 400/208.1, 194, 195, 196, 196.1, 211, 242, 247

[56] References Cited

U.S. PATENT DOCUMENTS

| | | | |
|---|---|---|---|
| 4,352,578 | 10/1982 | Dunning et al. | 400/207 |
| 4,408,914 | 10/1983 | Ciesiel | 400/208 |
| 4,469,454 | 9/1984 | Crean | 400/144.2 |
| 4,606,662 | 8/1986 | Komplin | 400/214 |
| 4,623,272 | 11/1986 | Kondo | 400/208 |
| 4,624,592 | 11/1986 | Purcell | 400/208 |
| 4,629,345 | 12/1986 | Suzaki | 400/208 |
| 4,650,355 | 3/1987 | Cassiano | 400/196.1 |
| 4,729,676 | 3/1988 | Smith | 400/196.1 |
| 4,798,486 | 1/1989 | Kaneko | 400/208 |
| 4,867,586 | 9/1989 | Shimoyama | 400/208 |

FOREIGN PATENT DOCUMENTS

| | | | |
|---|---|---|---|
| 12849 | 4/1978 | Japan | 400/208 |
| 174180 | 1/1986 | Japan | 400/207 E |

OTHER PUBLICATIONS

IBM Technical Disclosure Bulletin, vol. 27, No. 4A, Sep. 1984, "Molded Tension Spring for Ribbon Cartridge".

*Primary Examiner*—David A. Wiecking
*Assistant Examiner*—Eric P. Raciti
*Attorney, Agent, or Firm*—Staas & Haley

[57] ABSTRACT

A mounting mechanism for a ribbon cassette for mounting the ribbon cassette on a carrier of a printer having a pair of resiliently deformable arms which are formed in such a manner as to extend forwardly along the opposite side walls from a rear end of the ribbon cassette, and a pin is formed in an integrated relationship on each of the arms. A pair of holes for receiving the pins are formed on the carrier side of the printer, and the ribbon cassette is mounted onto the carrier by resiliently deforming the arms to fit the pins into the holes of the carrier.

8 Claims, 4 Drawing Sheets

MOUNTING MECHANISM FOR RIBBON CASSETTE

This application is copending with application Ser. No. 07/540209, filed Jun. 19, 1990.

BACKGROUND OF THE INVENTION

This invention relates to a mounting mechanism for a ribbon cassette for removably mounting onto a printing station of a printer a ribbon cassette in which an ink ribbon is accommodated.

In a high grade printer, the operability in mounting and removing a ribbon cassette is considered important, and also a mounting mechanism for a ribbon cassette is complicated. However, in an inexpensive printer, thorough reduction in cost is required for every part.

FIG. 1 shows an exemplary one of conventional mounting mechanisms for a ribbon cassette. A pair of pins 2 are securely provided on the opposite sides of a ribbon cassette 1 while, on the side of a carrier or carriage 3 of a printer, a pair of recesses 6 for engaging with the pins 2 of such ribbon cassette 1 are formed on a carrier frame 4 and a pair of holders 5 which are supported for pivotal motion on the carrier frame 4 each by means of a pin 8. Each of the holders 5 is normally urged in the clockwise direction in FIG. 1 by a torsion spring 7.

When the ribbon cassette 1 is moved in the direction indicated by an arrow mark P, each of the holders 5 is pivoted a little in the counterclockwise direction in FIG. 1 against the corresponding torsion spring 7 by pushing of the corresponding pin 2 to allow the pin 2 to be fitted into the recess 6 formed on the carrier frame 4. After the pin 2 is fully fitted into the recess 6 of the carrier frame 4 in this manner, the holder 5 is pivoted back in the clockwise direction in FIG. 1 by the urging force of the torsion spring 7 until the recess 6 of the holder 5 presses against the pin 2 of the ribbon cassette 1 from above. Thus, the ribbon cassette 1 is mounted in position on the carrier 3 with the pins 2 thereof received in the recesses 6.

In such conventional mounting mechanism for a ribbon cassette as described above, the ribbon cassette 1 is simple in structure because only the pins 2 are provided thereon. However, there is a disadvantage that a considerable part cost and assembly cost are required because it is necessary to provide on the carrier side the holders 5 for receiving such pins 2 and the torsion springs 7 and pins 8 for the holders 5.

SUMMARY OF THE INVENTION

Accordingly, it is an object of the present invention to provide a mounting mechanism for a ribbon cassette which can be reduced in number of parts to the utmost to reduce the cost thereof remarkably.

In accordance with an aspect of the present invention, there is provided a mounting mechanism for a ribbon cassette for removably mounting on a carrier of a printer the ribbon cassette in which an ink ribbon is accommodated, which comprises a pair of resilient members formed for resilient deformation in an integrated relationship on the ribbon cassette, a first arresting means provided on each of the resilient members for arresting the ribbon cassette on the carrier, and a pair of second arresting means provided on the carrier and each adapted to be engaged with a corresponding one of the first arresting means.

By resiliently deforming the resilient members, the ribbon cassette is mounted onto the carrier with the first arresting means arrested to the second arresting means.

The mounting mechanism for a ribbon cassette of the present invention further comprises stopper means for stopping the ribbon cassette in a predetermined posture when the ribbon cassette is mounted on the carrier, and urging means for urging the ribbon cassette in a direction toward the predetermined posture in which the ribbon cassette is controlled by the stopper means. Preferably, the pair of resilient members are formed in an integrated relationship by plastic molding in such a manner as to extend from the ribbon cassette.

The above and other objects, features and advantages of the present invention and the manner of realizing them will become more apparent, and the invention itself will best be understood, from a study of the following description and appended claims with reference had to the attached drawings showing some preferred embodiments of the invention.

DESCRIPTION OF THE PREFERRED EMBODIMENTS

Embodiments of the present invention will be described in detail with reference to the drawings.

Figure 1:
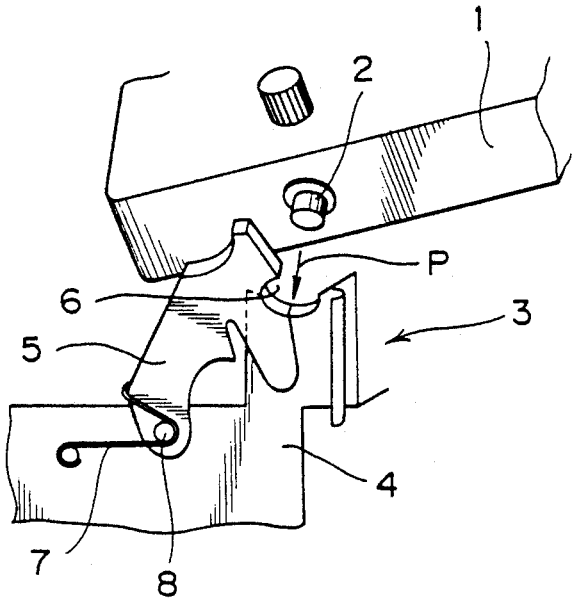
FIG. 1 PRIOR ART
FIG. 1 is a partial perspective view showing a conventional mounting mechanism for a ribbon cassette.
Figure 2:
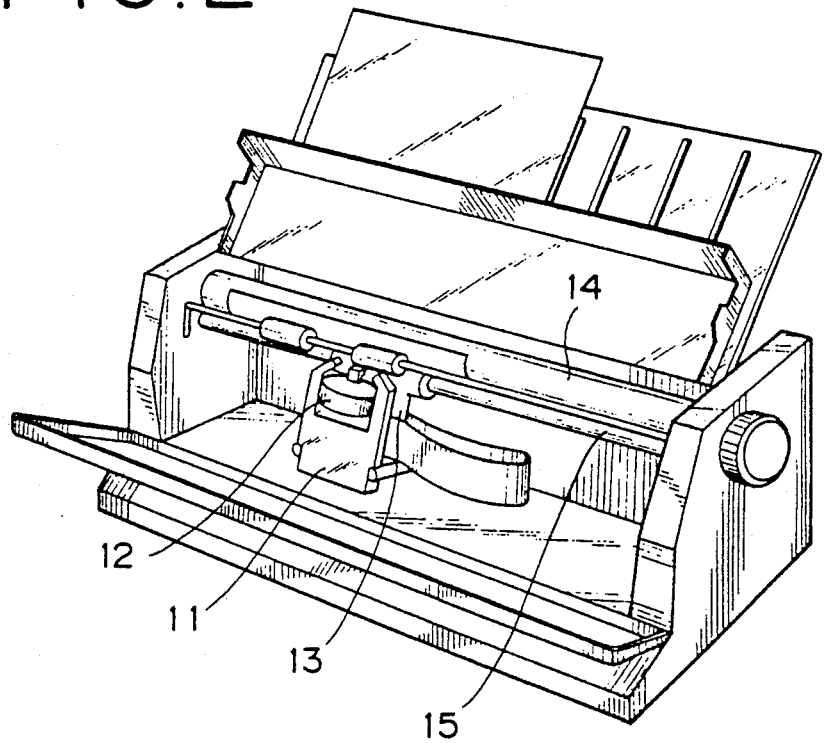
FIG. 2 is a perspective view of an entire printer to which a mounting mechanism for a ribbon cassette according to the present invention is applied.

Referring first to FIG. 2 which shows general construction of a printer, a carrier or carriage 13 is moved along a stay shaft 15 in a direction parallel to an axis of a platen roll 14 by a spacing motor not shown. A print head 12 is securely carried on the carrier 13 in an opposing relationship to the platen roll 14. A ribbon cassette 11 is removably mounted on the carrier 13.

Figure 3:
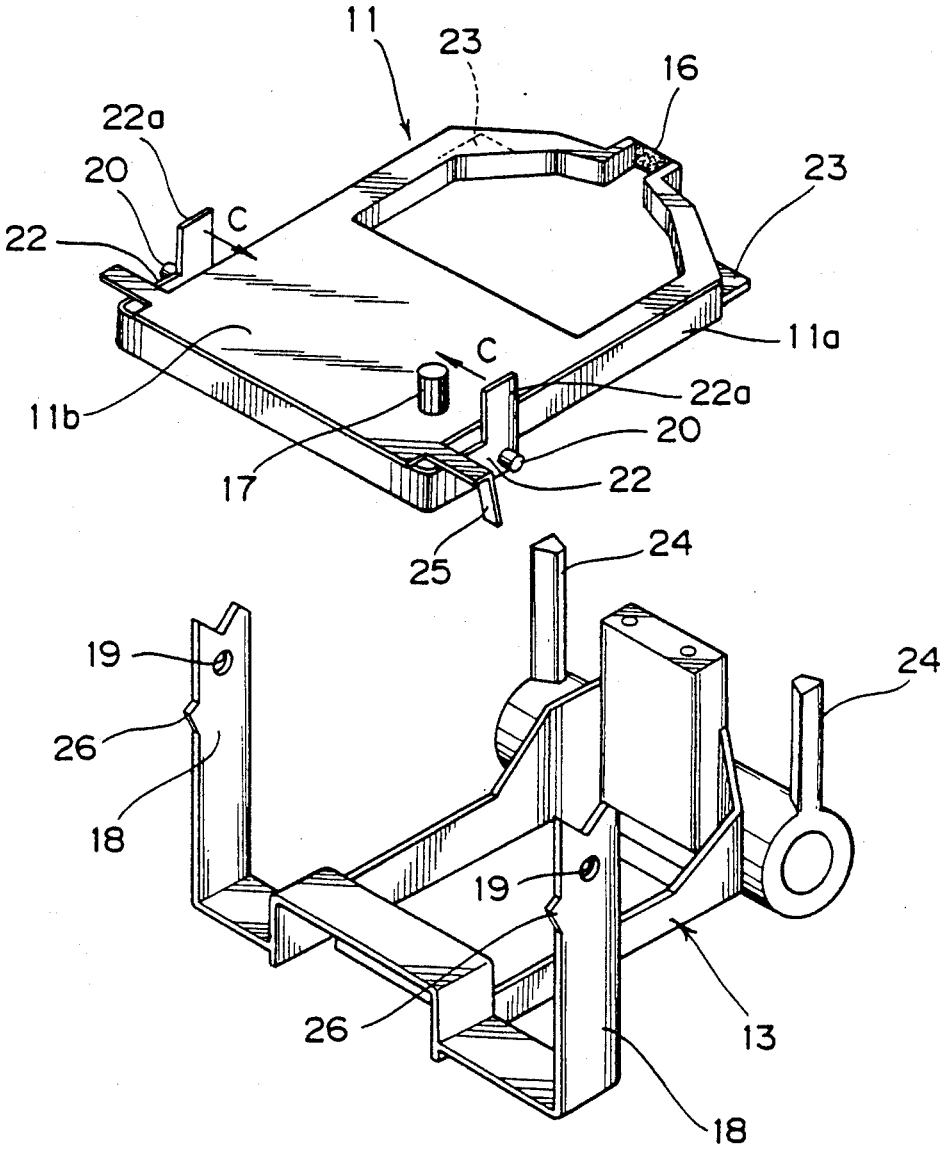
FIG. 3 is an exploded perspective view of a mounting mechanism for a ribbon cassette showing a preferred embodiment of the present invention.
Figure 4:
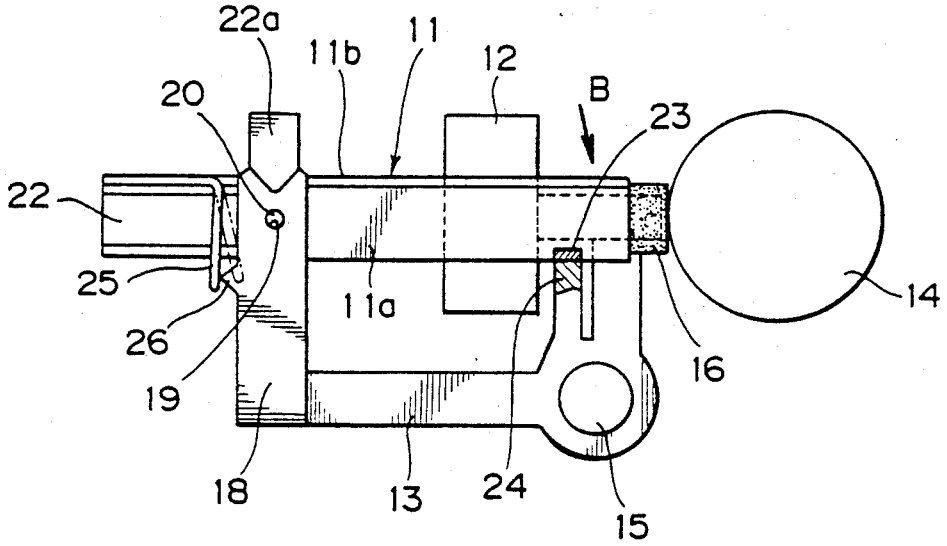
FIG. 4 is a side elevational view of the mounting mechanism of FIG. 3.
Figure 5:
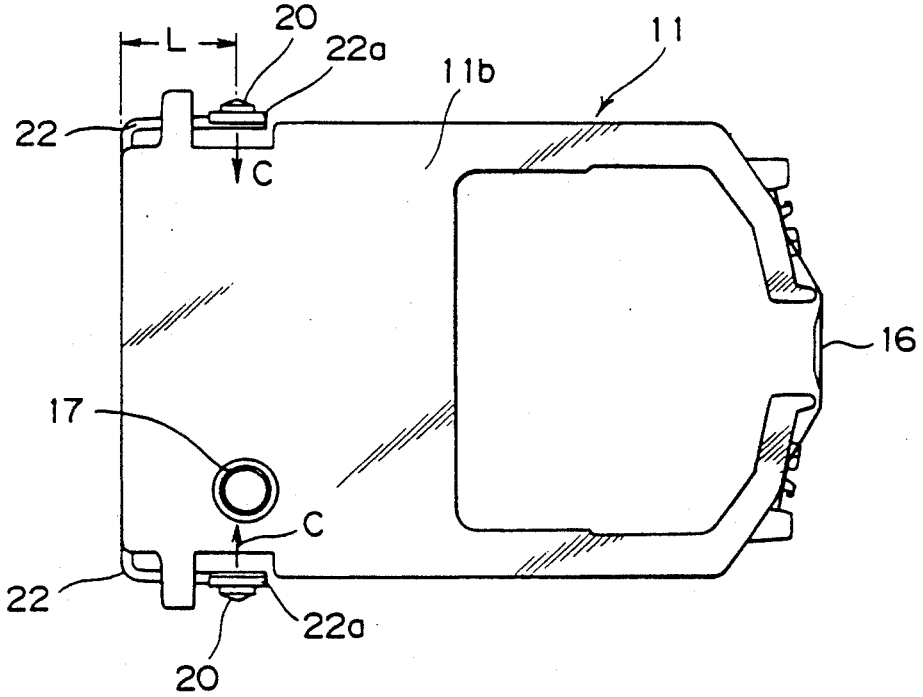
FIG. 5 is a plan view of the mounting mechanism of FIG. 3.

Subsequently, a mounting mechanism for a ribbon cassette of an embodiment of the present invention will be described with reference to FIGS. 3 to 5. The ribbon cassette 11 is formed by plastic molding and includes a case 11*a* and a lid member 11*b* which are fitted with each other. An ink ribbon 16 is accommodated in the ribbon cassette 11. In a normal condition of the ink ribbon 16, a portion thereof is exposed outside the ribbon cassette 11 at a forward end portion of a widthwise central portion of the ribbon cassette 11 and runs between the print head 12 and the platen roll 14. A knob 17 for manually taking up the ink ribbon 16 is provided on the ribbon cassette 11.

A pair of support posts 18 formed by molding of a plastic material are provided uprightly at the opposite side portions of the carrier 13, and the ribbon cassette 11 is supported for pivotal motion on the support posts 18.

In particular, a hole 19 is formed in each of the support posts 18 while a pair of pins 20 are provided projectingly on the ribbon cassette 11 and are fitted for rotation in the holes 19 of the support posts 18.

The pins 20 are formed at end portions of a pair of arms 22 which extend forwardly from the opposite widthwise ends of a rear end of the case 11*a* of the ribbon cassette 11 along the opposite side walls of the case 11*a*. The pins 20 are formed by molding of a plastic material in an integrated relationship with the case 11*a* together with the arms 22. The arms 22 are resiliently deformable at least toward the inside as indicated by arrow marks C in FIGS. 3 and 5, and since the arms 22 extend forwardly from the rear end portions of the ribbon cassette 11 along the opposite side walls of the case 11*a* of the ribbon cassette, an arm length L required for resilient deformation of the arms 22 is assured sufficiently (refer to FIG. 5).

Each of the pins 20 has a top portion which is shaped in a gentle conical shape in order to facilitate insertion thereof into a hole 19, and each of the arms 22 is bent in an L-shape at an end portion thereof to provide a projecting piece 22*a* which projects upwardly. Accordingly, if the projecting pieces 22*a* of the arms 22 provided on the opposite sides of the ribbon cassette 11 are pushed inwardly (in the directions indicated by the arrow marks C) to resiliently deform a little with fingers of a hand, then the pins 20 can be inserted into or removed from the holes 19 to freely mount or remove the ribbon cassette 11 onto or from the carrier 13.

A pair of projecting pieces 23 are formed integrally at corner portions of the case 11*a* of the ribbon cassette 11 while a pair of stoppers 24 in the form of rods are provided on the carrier 13 for engaging, when the ribbon cassette 11 is mounted onto the carrier 13, with the projecting pieces 23 of the ribbon cassette 11 to stop the ribbon cassette 11 in a fixed posture. When the projecting pieces 23 of the ribbon cassette 11 remain in engagement with the stoppers 24, the ink ribbon 16 runs at a position at which it is opposed properly to the print head 12.

A pair of inverted L-shaped urging pieces 25 are formed at rear portions of the lid member 11*b* of the ribbon cassette 11 in an integrated relationship with the lid member 11*b* by plastic molding. The urging pieces 25 in a free condition assume an inclined posture with respect to the support posts 18 as indicated in phantom in FIG. 4. Then, when the ribbon cassette 11 is mounted on the carrier 13, the urging pieces 25 are engaged with a pair of projections 26 formed on rear faces of the support posts 18 as indicated in solid lines in FIG. 4. Consequently, the ribbon cassette 11 is urged in the direction indicated by an arrow mark B in FIG. 4, that is, in a direction in which the projecting pieces 23 of the ribbon cassette 11 are engaged with the stoppers 24 of the carrier 13.

In this manner, the ribbon cassette 11 is urged by the urging pieces 25 so that the projecting pieces 23 thereof are engaged with the stoppers 24 of the carrier 13, thereby maintaining the properly positioned condition of the ribbon cassette 11 opposing to the print head 12.

Figure 6:
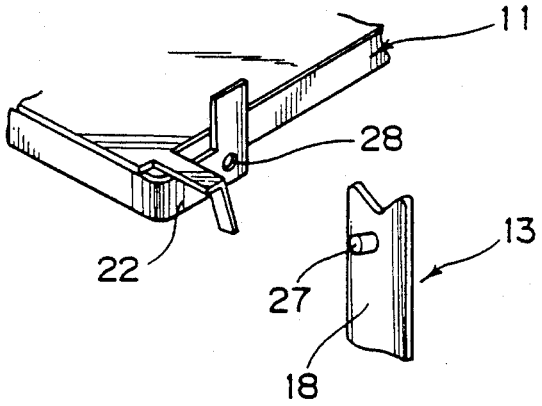
FIG. 6 is a fragmentary exloded perspective view of a mounting mechanism for a ribbon cassette showing another embodiment of the present invention.

It is to be noted that, while the pins 20 are formed on the ribbon cassette 11 and the holes 19 are formed in the carrier 13 in the embodiment described above, alternatively a pair of pins 27 may be provided on the carrier 13 while a pair of holes 28 are formed in the ribbon cassette 11 as shown in FIG. 6. Further, some other retaining means than a pin and a hole may otherwise be employed.

Figure 7:
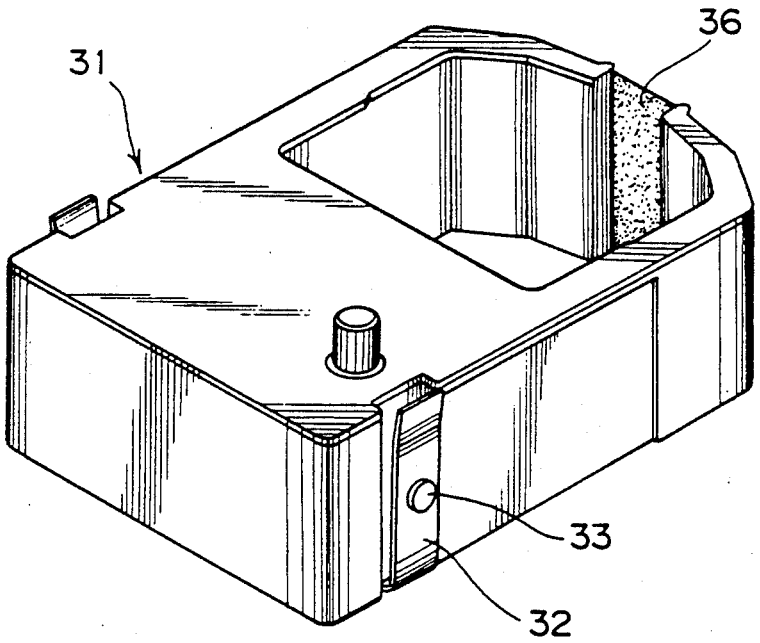
FIG. 7 is a perspective view of a color ribbon cassette showing a further embodiment of the present invention.

Referring now to FIG. 7, there is shown a color ribbon cassette 31 in which a multi-color ink ribbon 36 for color printing is accommodated. In this instance, since the ink ribbon 36 has a great width and the color ribbon cassette 31 has a great height as much, a pair of arms 32 can be projected upwardly from a lower end of the ribbon cassette 31. A pin 33 is formed integrally on each of the arms 32 for mounting the color ribbon cassette 31 for pivotal motion on a carrier, and the color ribbon cassette 31 can be removably mounted on the carrier 13 in place of the ribbon cassette 11 shown in FIGS. 3 to 5.

According to the mounting mechanisms for a ribbon cassette of the present invention described in detail so far, since a pair of resiliently deformable arms are formed in an integrated relationship on a ribbon cassette, such parts as a holder which are conventionally required in a carrier can be eliminated, the number of parts can be minimized, and consequently, the part cost and assembly cost can be reduced remarkably.

What is claimed is:

1. A mounting mechanism for a ribbon cassette for removably mounting the ribbon cassette on a carrier of a printer, the ribbon cassette having an ink ribbon accommodated therein, comprising:

a pair of resilient members formed integrally with the ribbon cassette, said resilient members extending along two sides of the ribbon cassette and being deformable at least toward each other;

a pair of first arresting means each provided on said respective resilient members for arresting the ribbon cassette when mounted on said carrier;

a pair of second arresting means provided on said carrier, each of said second arresting means being adapted to be engaged with a corresponding one of said first arresting means;

stopper means provided on said carrier for stopping the ribbon cassette in a predetermined posture when the ribbon cassette is mounted on said carrier; and a pair of urging means each formed integrally with the ribbon cassette for urging the ribbon cassette in a direction toward the predetermined posture in which the ribbon cassette is stopped by said stopper means.

2. A mounting mechanism for a ribbon cassette according to claim 1, wherein said pair of resilient members are formed integrally with the ribbon cassette by plastic molding.

3. A mounting mechanism for a ribbon cassette according to claim 1, wherein each of said first arresting means is a projection while each of said second arresting means is a hole.

4. A mounting mechanism for a ribbon cassette according to claim 1, wherein each of said first arresting means is a hole while each of said second arresting means is a projection.

5. A mounting mechanism for a ribbon cassette according to claim 1, wherein each of said first arresting means is formed integrally with said resilient members by plastic molding.

6. A mounting mechanism for a ribbon cassette for removably mounting the ribbon cassette on a carrier of a printer, the ribbon cassette having an ink ribbon accommodated therein, comprising:

a pair of resilient arms formed integrally with the ribbon cassette by plastic molding, said resilient arms extending along two sides of the ribbon cassette and being deformable at least towards each other;

a pair of first arresting means each provided on said respective resilient arms for arresting the ribbon cassette when mounted on said carrier, said first arresting means being integrally formed with said resilient arms by plastic molding;

a pair of support members formed integrally with said carrier by plastic molding;

a pair of second arresting means each provided on said respective support members, each of said second arresting means being adapted to be engaged with a corresponding one of said first arresting means;

stopper means for stopping the ribbon cassette in a predetermined posture when the ribbon cassette is mounted on said carrier; and a pair of urging pieces each formed integrally with the ribbon cassette for urging the ribbon cassette in a direction towards the predetermined posture in which the ribbon cassette is stopped by said stopper means.

7. A mounting mechanism for removably mounting a cassette on a carrier of a printer, comprising:

a pair of resilient arms extending along opposite sides of the cassette;

a pair of pins respectively provided on said resilient arms;

a pair of support posts respectively mounted on said carrier;

a pair of holes respectively provided on said support posts, each of said holes receiving and rotatably supporting a corresponding one of said pins;

stopper means, mounted on said carrier, for positioning the cassette in a predetermined posture relative to the carrier by engaging a predetermined portion of the cassette when said pins are received and rotatably supported in said holes; and a pair of urging pieces formed integrally with the cassette for urging the cassette into said predetermined posture by rotatably biasing the cassette about said pins so that said predetermined portion of the cassette engages said stopper means when said pins are received and rotatably supported in said holes.

8. A mounting mechanism for removably mounting a cassette on a carrier of a printer, comprising:

a pair of resilient arms extending along opposite sides of the cassette;

a pair of holes respectively provided on said resilient arms;

a pair of support posts respectively mounted on said carrier;

a pair of pins respectively provided on said support posts, each of said holes on said resilient arms receiving and rotatably supporting a corresponding one of said pins on said support posts;

stopper means, mounted on said carrier, for positioning the cassette in a predetermined posture relative to the carrier by engaging a predetermined portion of the cassette when said pins are received and rotatably supported in said holes; and a pair of urging pieces formed integrally with the cassette for urging the cassette into said predetermined posture by rotatably biasing the cassette about said pins so that said predetermined portion of the cassette engages said stopper means when said pins are received and rotatably supported in said holes.

* * * * *